US006241594B1

(12) United States Patent
Lepold

(10) Patent No.: US 6,241,594 B1
(45) Date of Patent: Jun. 5, 2001

(54) HAND MACHINE TOOL ADJUSTABLE FRONT HANDLE

(75) Inventor: Holger Lepold, Steinheim (DE)

(73) Assignee: Flex-Elektrowerkzeuge, Steinheim (DE)

( * ) Notice: Subject to any disclaimer, the term of this patent is extended or adjusted under 35 U.S.C. 154(b) by 0 days.

(21) Appl. No.: 09/443,851

(22) Filed: Nov. 19, 1999

(30) Foreign Application Priority Data

Nov. 25, 1998 (DE) ..... 198 54 468

(51) Int. Cl.[7] ..... B24B 23/00

(52) U.S. Cl. ..... 451/359; 451/357; 81/177.6; 81/177.7; 81/177.8; 81/177.9

(58) Field of Search ..... 451/359, 357; 81/177.6, 177.7, 177.8, 177.9

(56) References Cited

U.S. PATENT DOCUMENTS

| | | | | |
|---|---|---|---|---|
| D. 337,712 | | 7/1993 | Cavedo . | |
| 1,907,904 | | 5/1933 | Van Emburg et al. . | |
| 2,545,659 | | 3/1951 | Ginter . | |
| 4,060,940 | * | 12/1977 | DeWitt | 451/358 |
| 4,188,934 | * | 2/1980 | Reinhardt et al. | 125/4 |
| 4,276,675 | | 7/1981 | Pioch . | |
| 4,368,556 | | 1/1983 | Wanner et al. . | |
| 4,749,049 | | 6/1988 | Greppmair . | |
| 4,820,090 | | 4/1989 | Chen . | |
| 4,881,294 | | 11/1989 | Riedl . | |
| 4,891,915 | | 1/1990 | Yasuda . | |
| 5,058,909 | * | 10/1991 | Rudolf et al. | 279/8 |
| 5,170,532 | | 12/1992 | Holmin et al. . | |
| 5,898,974 | | 5/1999 | Boyer . | |

FOREIGN PATENT DOCUMENTS

| | | |
|---|---|---|
| 3921752 A1 | 1/1991 | (DE) . |
| 4203171 C1 | 6/1993 | (DE) . |
| 44 22 247 A1 | 1/1996 | (DE) . |
| 4422245 A1 | 1/1996 | (DE) . |
| 195 07 955 A1 | 9/1996 | (DE) . |
| 0 249 037 A2 | 12/1987 | (EP) . |

OTHER PUBLICATIONS

"Tools On Sale™", A Division of Seven Corners Hdwe., Inc., 2 un–number pages and pp. 313–318 (total 8 pages) (1995).

"Tools On Sale™", A Division of Seven Corners Hdwe., Inc., 2 un–number pages and pp. 342–347 (total 8 pages) (1997).

* cited by examiner

*Primary Examiner*—Joseph J. Hail, III
*Assistant Examiner*—Shantese McDonald
(74) *Attorney, Agent, or Firm*—Merchant & Gould P.C.

(57) ABSTRACT

In order to provide a hand machine tool comprising an elongated housing, a drive motor which is arranged in the housing and with which a tool holder can be driven via a miter gear, a first handle unit arranged on a housing section located close to the tool holder and aligned transversely to a longitudinal axis of the housing and a second handle unit arranged on the housing, with which the alignment of the first handle unit relative to the axis of rotation of the tool holder may be varied, it is suggested that the first handle unit be held for guidance in an adjusting guide means on the housing and in this adjusting guide means be adjustable within an angular range of at least 90° about a longitudinal axis of the housing between several possible positions and be fixable in a positive-locking manner in the respective position.

20 Claims, 9 Drawing Sheets

7

30
133
132
130
106
144
122
120
134
82
104
138
60
96
64
108
84
44
40
72
100
70
136
140
72
38
62
98
66
86
80
46
88
92
52
94
110
50
54
90
7

HAND MACHINE TOOL ADJUSTABLE FRONT HANDLE

The invention relates to a hand machine tool comprising an elongated housing, a drive motor which is arranged in the housing and with which a tool holder can be driven via a miter gear, a first handle unit arranged on a housing section located close to the tool holder and aligned transversely to a longitudinal axis of the housing and a second handle unit arranged on the housing.

Hand machine tools of this type are known from the state of the art. Hand machine tools of this type are, in many cases, designed as angle grinders which are provided for a plurality of grinding and cutting work.

In this respect, the handling capability of the machine tool is dependent on the alignment of the first handle unit relative to an axis of rotation of the tool holder.

The object underlying the invention is therefore to provide a hand machine tool, with which the alignment of the first handle unit relative to the axis of rotation of the tool holder can be varied.

This object is accomplished in accordance with the invention, in a hand machine tool of the type described at the outset, in that the first handle unit is held for guidance in an adjusting guide means on the housing and in this adjusting guide means can be adjusted within an angular range of at least 90° about the longitudinal axis of the housing between several possible positions and can be fixed in a positive-locking manner in the respective position.

The advantage of the inventive solution is to be seen in the fact that as a result of the guidance of the handle unit in the adjusting guide means a complete detachment of the handle unit from the housing is avoided during the adjustment and so the handle unit always remains in connection with the housing and, on the other hand, due to the positive-locking fixing the possibility is also created of securely fixing the handle unit in the intended position which is desirable for a good equipment safety of the hand machine tool since any undesired releasing of the handle unit in the respective position, which would be possible with a force-locking fixing, can thus be prevented.

A positive-locking fixing is thereby to be understood as all the possibilities for realizing this which provide for one positive-locking element to engage in another. In this respect, one of the positive-locking elements can, in the simplest case, be designed as a rippled or wavy surface, the other positive-locking element then engaging in its recesses with a nose.

The adjusting guide means may be designed in the most varied of ways.

One advantageous solution provides for the adjusting guide means to comprise a guide path guiding a guide member connected to the first handle unit in a positive-locking manner between the various positions.

In principle, it would be conceivable to design the guide path completely independently of the outer contour of the housing.

However, in order to be able to integrate the guide path into the housing in a simple manner it is preferably provided for the guide path to extend along an outer contour of the housing.

It is particularly advantageous when the guide path is arranged so as to be recessed in relation to the outer contour of the housing so that the guide path can be protected against any type of damage.

A particularly favorable design of the adjusting guide means provides for the adjusting guide means to have at least one guide bar which extends in the direction of guidance and behind which the guide member connected to the handle unit engages.

As a result, a particularly simple and functional adjusting guide means can be realized.

With respect to the possibilities for the positive-locking fixing of the handle unit in the various positions, no further details have so far been given. It would, for example, be possible to provide the positive-locking fixing separately from the guide path. It would, for example, be conceivable to arrange the positive-locking elements for the fixing of the handle unit in the various positions next to the guide path.

For reasons of space and for reasons of as simple a constructional solution as possible, it is particularly favorable when the guide bar is provided with a row of positive-locking elements which can be brought into engagement with corresponding positive-locking elements on the guide member connected to the first handle unit.

The guide member is, as a result, not only provided for the purpose of guiding the handle unit in the adjusting guide means but it is also used at the same time for the purpose of realizing the positive-locking connection in the respective positions.

In order to ensure that the positive-locking elements transfer into their positive-locking position and remain in it, a securing element is preferably provided which acts on the positive-locking elements in order to keep these in their positive-locking position and when they are not in their positive-locking position to transfer them into it.

A particularly simple design of such a securing element from a constructional point of view provides for this to comprise a retaining spring which acts on the positive-locking elements in such a manner that they transfer into their positive-locking position, and remain in this position.

With respect to the arrangement of the securing element, the most varied of possibilities are conceivable. For example, it would be conceivable to arrange the securing element as a separate element independent of the adjusting guide means. However, a particularly favorable solution provides for the securing element to be arranged so as to be supported on the adjusting guide means.

An alternative solution provides for the securing element to be arranged in the handle unit.

In order to ensure that the positive-locking elements transfer from their positive-locking position into their non-positive-locking position and thus the handle unit is movable in the adjusting guide means, it is necessary to provide an actuating element for the securing element. Such an actuating element could, for example, be an additional element provided in the handle unit, such as, for example, an actuating lever or an actuating knob.

A particularly simple solution from a constructional point of view provides for the securing element to be actuatable via a handle of the handle unit, for example, in the case of a retaining spring to be acted upon contrary to the force of the spring.

In conjunction with the preceding description of the individual embodiments, no further details have so far been given as to how the fixing of the first handle unit is intended to be brought about in the respective positions. It would, for example, be adequate, in order to hold the handle unit in this position, to fix it in a positive-locking manner in this position also with a certain play.

In order to facilitate a secure and precise working with the hand machine tool it is, however, particularly advantageous when the first handle unit can be positioned on the housing free from play in the respective position fixed in a positive-locking manner by means of a clamping device.

The advantage of this solution is to be seen in the fact that the positioning of the handle unit relative to the housing is indeed possible by way of the positive-locking fixing thereof but this positioning is still subject to play, wherein play does not have a disadvantageous effect on fundamental safety aspects which are realized by the adjusting guide means and the positive-locking fixing in the respective position. As a result of the additional fixing free from play by means of a clamping device the desired, rigid and precise alignment of the handle unit in relation to the housing is, however, ensured.

Such a clamping device may be realized in various ways. A particularly favorable solution provides for the clamping device to have a clamping element, with which a support element of the handle unit can be abutted against the housing in a clamped manner.

The clamping element which must itself engage on the housing in order to abut the support element on the housing in a clamped manner is preferably designed such that it engages on the guide member guided in the adjusting guide means.

The clamping element could be designed, for example, as a resiliently elastic element.

A particularly favorable solution does, however, provide for the clamping element to be designed as a clamping gear element, with which large forces for the clamping of the handle unit in relation to the housing may be realized in a simple manner.

A particularly simple and inexpensive solution provides for the clamping element to be designed as a clamping spindle.

With respect to the possible positions of the handle unit in the adjusting guide means, no further details have so far been given. It would, for example, be conceivable to realize the positive-locking fixing such that an essentially continuous positioning of the handle unit along the adjusting guide means is possible.

On the other hand, it is of advantage in order to bring about a secure, positive-locking positioning of the handle unit when the first handle unit can be fixed discontinuously in a positive-locking manner. A discontinuous, positive-locking fixing creates the possibility of specifying individual fixing points from the outset which can then be realized in a constructionally simple manner.

In principle, it would be possible to realize the discontinuous, positive-locking fixing of the handle unit such that the first handle unit can be fixed discontinuously in a positive-locking manner in steps of smaller than to equal to 90°.

It is, however, even more advantageous when the first handle unit can be fixed discontinuously in a positive-locking manner in steps of smaller than to equal to 30°.

With regard to the type of fixing of the handle unit in the adjusting guide means, nothing has so far been said concerning essential positions which are significant for the use of the hand machine tool. One advantageous solution provides in this respect for the handle unit to be aligned in one of the possible positions approximately parallel to the axis of the tool holder. This solution ensures that with the possible positions of the handle unit such a position can also be reached which preferably permits the use of the inventive hand machine tool for the cutting of objects with a favorable ergonomic handling.

Another solution advantageous for the ergonomic handling provides for the handle unit to be aligned in one of the possible positions approximately at right angles to the axis of the tool holder since, with this alignment, it is ensured that roughing and grinding work, in particular, can be carried out advantageously with the inventive hand machine tool.

Further features and advantages of the invention are the subject matter of the following description as well as the drawings illustrating several embodiments.

Figure 1:
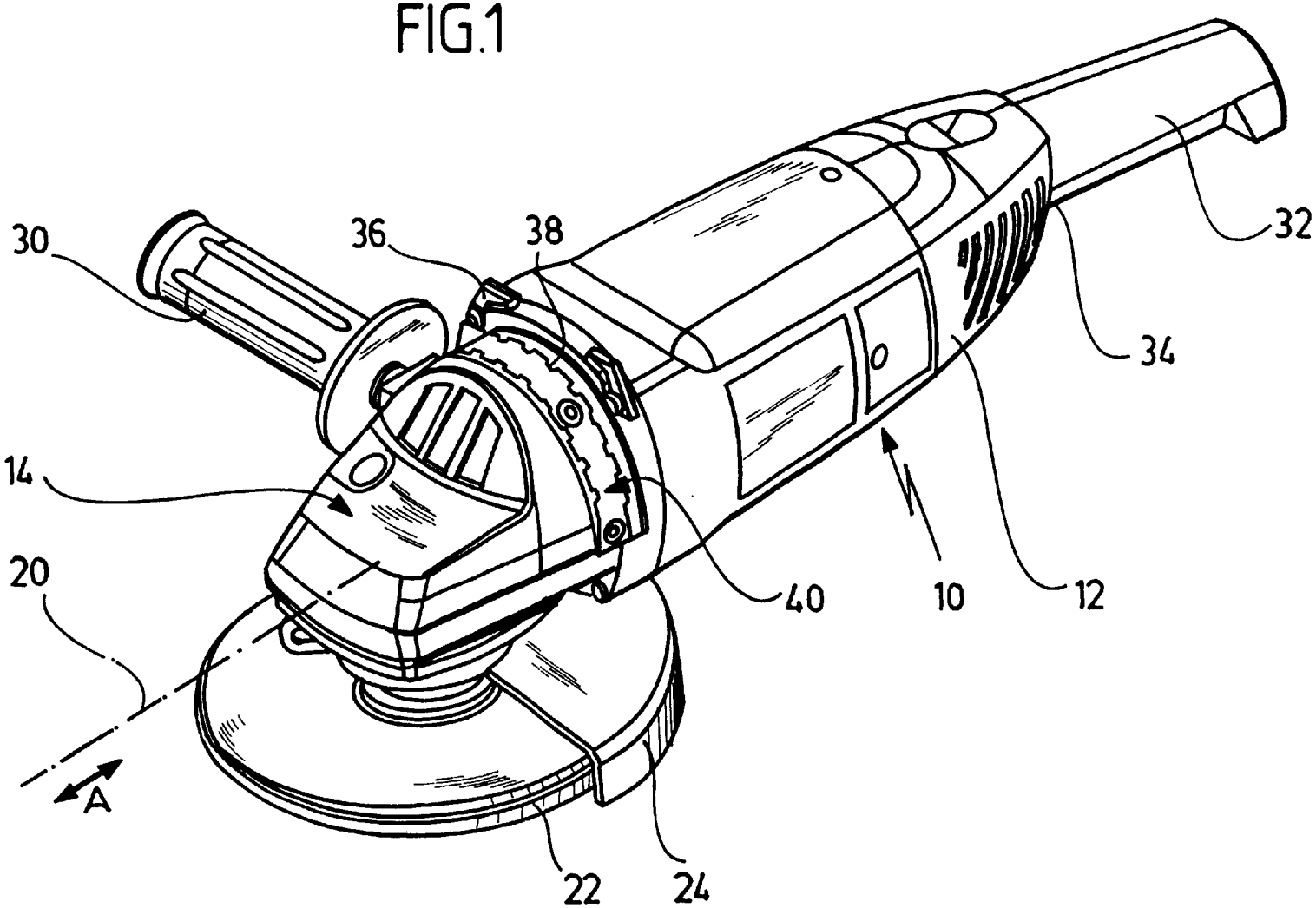
FIG. 1 shows a perspective illustration of a first embodiment of an inventive hand machine tool.
Figure 2:
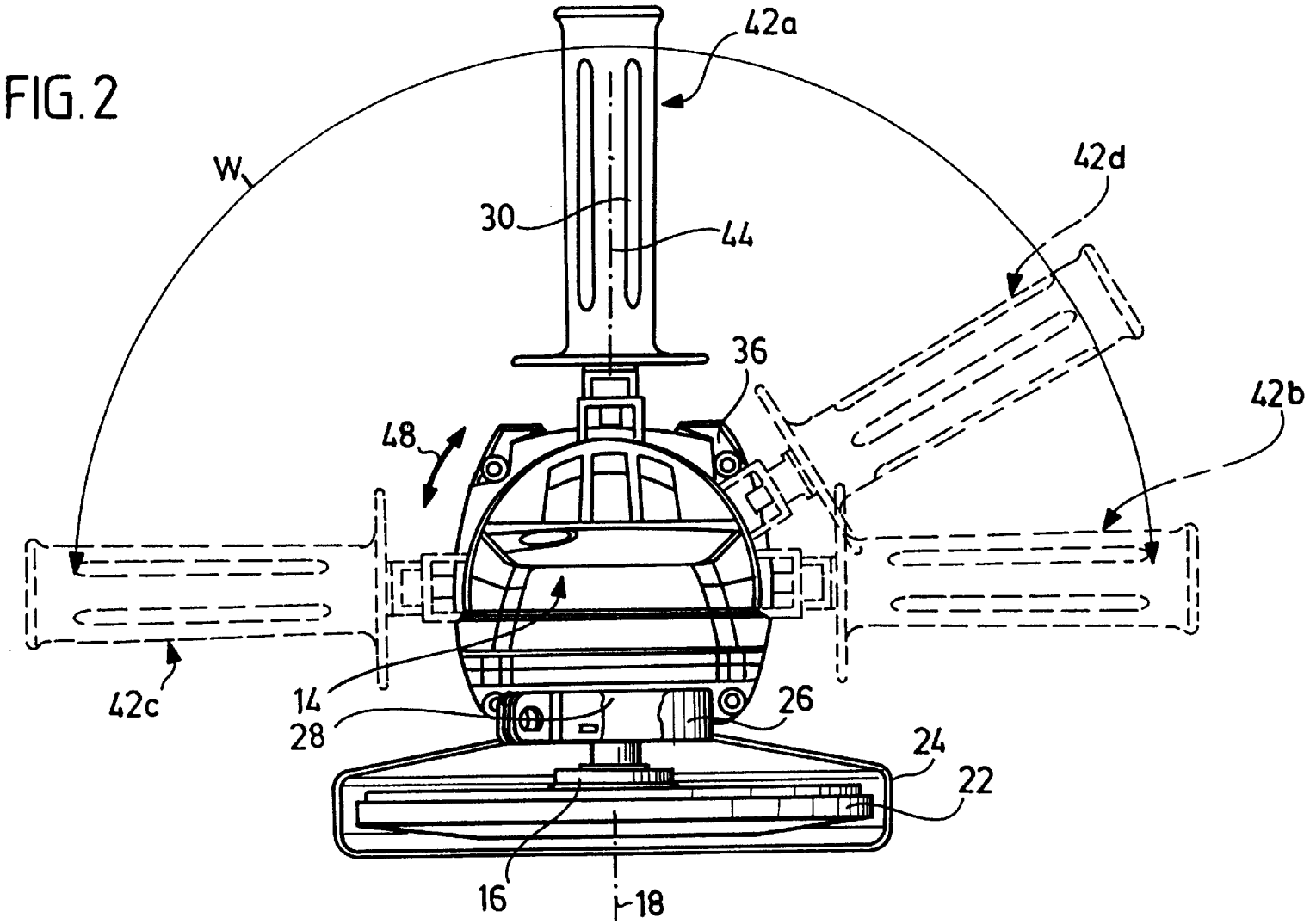
FIG. 2 shows a view of the hand machine tool in the direction of arrow A in FIG. 1.

One embodiment of an inventive, motor-driven hand machine tool illustrated in FIGS. 1 and 2 comprises a housing 10, in the motor housing section 12 of which a motor, for example, an electromotor is arranged. Furthermore, a gear housing section 14 adjoins the motor housing section 12 and in this section a miter gear is, for example, arranged which drives a tool holder 16 which is rotatable about an axis 18 which, for its part, extends transversely to a longitudinal axis 20 of the housing 10.

The tool holder 16 is designed, for example, as a holder for a grinding disc 22 which forms the driven tool.

A cover 24 for the tool 22 can preferably be fixed, in addition, on the gear housing section 14, wherein the cover 24, for example, engages around a cylindrical holding attachment on the gear housing section 14, which is arranged cylindrically to the axis 18, with a holding clip 28.

For the guidance of the hand machine tool, a first handle unit 30 is provided in the region of the gear housing 14 and, in addition, a possibility for holding the hand machine tool on a side of the motor housing section 12 located opposite the gear housing section 14. This is realized, for example, in the form of a second handle unit 32, wherein the latter preferably extends away from the motor housing section 12 approximately in the direction of the longitudinal axis.

Furthermore, a switch 34 is preferably provided in the handle unit 32 for switching on the hand machine tool.

As illustrated in FIGS. 1 and 2, an adjusting guide means for the first handle unit 30, which is designated as a whole as 40, is provided in the gear housing section 14, preferably in a segment 38 of the gear housing section 14 located close to a connection flange 36 for the fixing of the gear housing section 14 on the motor housing section 12 and so, as illustrated in FIG. 2, the first handle unit 30 can be positioned in an angular range W about the longitudinal axis 20 in a plurality of individual positions 42, wherein these individual positions 42 facilitate different handling of the hand machine tool. For example, the grinding disc 22 can be expediently used in the position 42*a* as a cutting disc for separating objects, wherein in the position 42*a* a central axis 44 of the handle unit 30 is aligned approximately parallel to the axis 18, about which the grinding disc 22 rotates.

In contrast thereto, the grinding disc 22 can preferably be used in a position 42*b* for roughing or sanding. The position 42*b* preferably corresponds to the position of the handle unit 30 suitable for roughing or sanding for right-handed users whereas a position 42*c* corresponds to the position for roughing or sanding for left-handed users.

The angular range W is preferably in the order of magnitude of approximately 180°.

In addition, further intermediate positions can be realized, such as, for example, the position 42*d,* which can be selected depending on the location and purpose of use.

Figure 3:
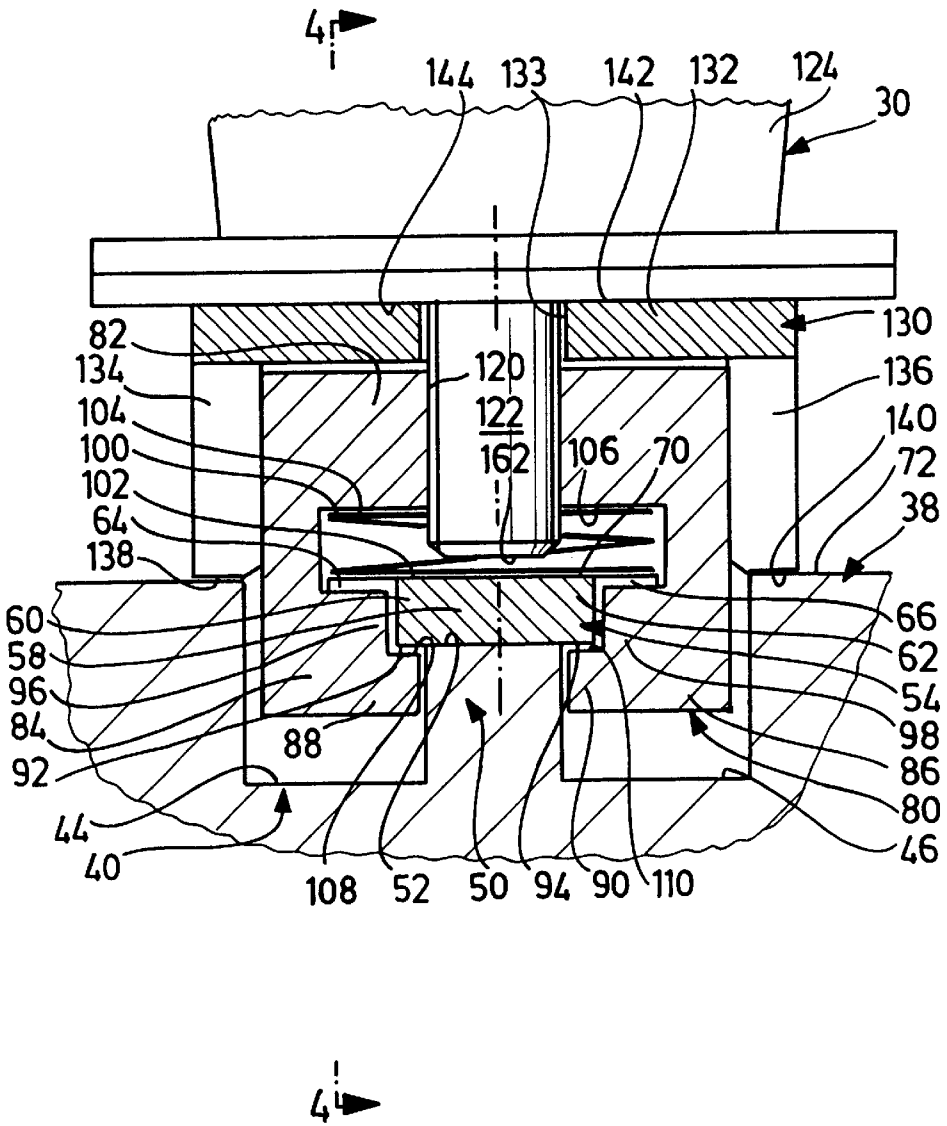
FIG. 3 shows a cross section through one subsection of the handle unit and the adjusting guide means in the first embodiment along line 3—3 in FIG. 4.
Figure 4:
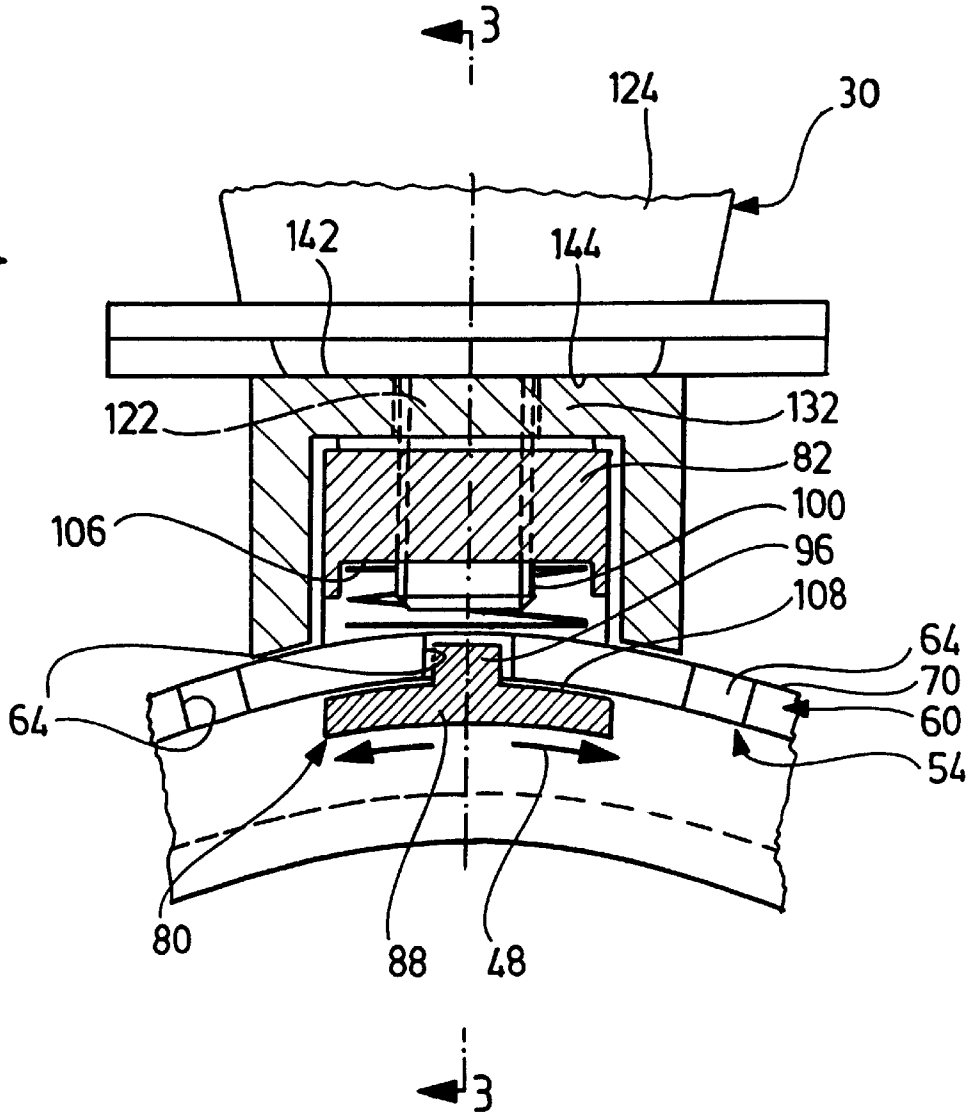
FIG. 4 shows a longitudinal section through the part of the handle unit and the adjusting guide means of the first embodiment illustrated in FIG. 3 along line 4—4 in FIG. 3.
Figure 5:
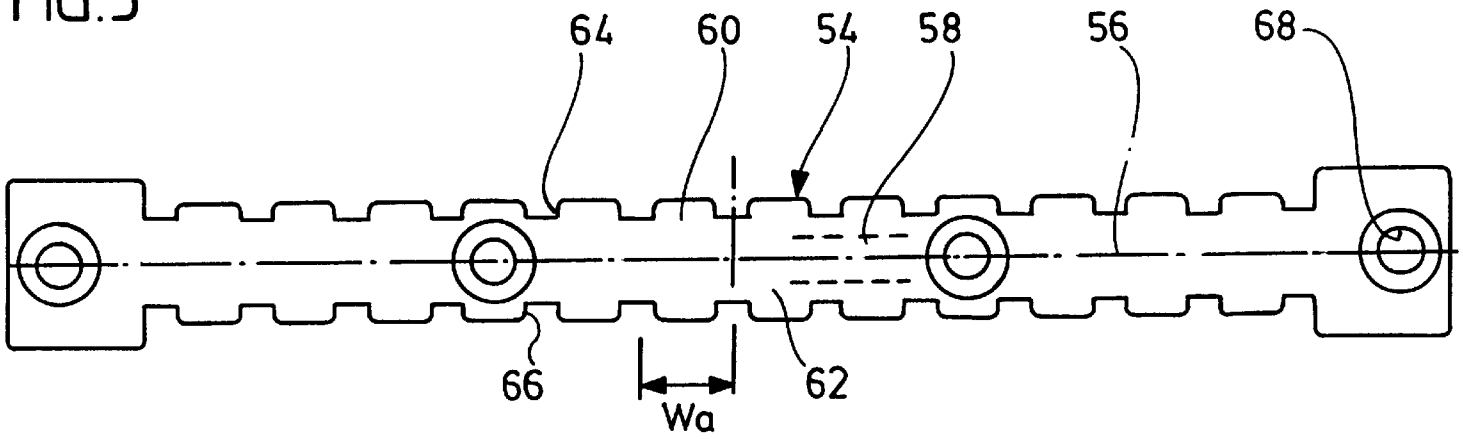
FIG. 5 shows a plan view of a guide element of the first embodiment in a rolled out illustration.

As illustrated in FIGS. 2 to 4, the adjusting guide means 40 comprises two grooves 44 and 46 which are formed into the segment 38, extend parallel to one another in azimuthal direction 48 in relation to the longitudinal axis 20 of the housing 10 and are separated from one another by a guide web 50. The guide web 50 bears on its upper side 52 a guide element which is designated as a whole as 54, extends, as illustrated in FIGS. 3 and 5, in the azimuthal direction 48 with its center line 56 and thereby rests with a central area 58 on the upper side 52 of the web but projects beyond the guide web 50 into the groove 44 or the groove 46 with guide bars 60 and 62, respectively, which adjoin the central area 58 on both sides thereof in continuation thereof. Furthermore, each of the guide bars 60 and 62 is provided with locking recesses 64 and 66 located opposite one another in relation to the center line 56, wherein the locking recesses 64 and 66 have, for example, an angular distance wa which is in the order of magnitude of 15°.

The guide element 54 can preferably be screwed onto the guide web in the state preshaped in accordance with the upper side 52 of the web with screws passing through the guide element 54 in screw holes 68 and engaging in the guide web 50.

Preferably, the guide element 54 of the adjusting guide means 40 is arranged on the guide web 50 and the guide web 50 designed such that an upper side 70 of the guide element 54 resting on the guide web 50 is aligned with an outer contour 72 of the segment 38 of the gear housing section 14 and extends in accordance with the shape of the outer contour 72.

In the simplest case, the outer contour 72 is thereby designed as a surface which is approximately cylindrical with respect to the longitudinal axis 20 and preferably circular-cylindrical. It would, however, also be conceivable to design the outer contour 72, for example, as an elliptical surface extending symmetrically with respect to the longitudinal axis 20.

The adjusting guide means 40 comprises, in addition, a guide member, which is designated as a whole as 80 and which has a central section 82 engaging over the upper side 70 as well as, proceeding from this, side sections 84, 86 engaging in the grooves 44 and 46, with holding sections 88, 90 which extend in the direction towards one another and engage behind the guide bars 60 and 62 on their undersides 92 and 94 located opposite the upper side 70 so that the guide member 80 is thus movable in the azimuthal direction 48 but is guided so as to be unreleasable from the guide element 54 of the adjusting guide means 40.

In addition, the holding sections 88, 90 comprise locking projections 96 and 98 which can be brought into engagement with the locking recesses 64 and 66 in order to facilitate a positive-locking securing in position of the guide member 80, wherein the holding sections 88 and 90 of the guide member 80 can dip into the grooves 44 and 46 to such an extent that the locking projections 96 and 98 are movable along the undersides 92 and 94 of the guide bars 60 and 62 in the azimuthal direction and by lifting the guide member in relation to the grooves 44 and 46 the locking projections 96 and 98 can be brought into engagement with the respectively reachable locking recesses 64 and 66.

In order to ensure that the guide member 80 does not endeavor to always dip into the grooves 44 and 46 with the holding sections 88 and 90 to such an extent that the guide member is in its position freely movable in the adjusting guide means 40 in the azimuthal direction 48 but rather the guide member 80 always endeavors to transfer into a position in the adjusting guide means 40 which is secured in a positive-locking manner and in which the locking projections 96 and 98 engage in the locking recesses 64 and 66, a pressure spring is provided as securing element 100 and this is supported with one end 102 on the upper side 70 of the guide element 54 and acts with an oppositely located end 104 against a pressure surface 106 of the central section 82 of the guide member 80 facing the upper side 70 and thus keeps the central section 82 always at the maximum possible distance from the upper side 70 of the guide element 54 so that, as a result, the locking projections 96 and 98 always endeavor to engage in the locking recesses 64 and 66 from the undersides 92 and 94 of the guide bars 60 and 62. In this position secured in a positive-locking manner, the holding sections 88 and 90 preferably abut with contact surfaces 108 and 110 facing the undersides 92 and 94 of the guide bars 60 and 62. A threaded bore 120 is provided, in addition, in the central section 82 of the guide member 80 and this is arranged approximately in the center of this section and a threaded pin 122, which is fixed on a handle 124 of the handle unit 30, can be screwed into it.

Although the handle unit 30 is, on the one hand, guided in the adjusting guide means 40 and, on the other hand, secured in a positive-locking manner as a result of the guide member 80, which, on the one hand, engages behind the guide bars 60 and 62 with the holding sections 88 and 90 and, on the other hand, engages in the locking recesses 64 and 66 with the locking projections 96 and 98, so that the handle 124, which is connected to the guide member 80 via the threaded pin 122 screwed into the threaded bore 120 thereof, is also securely guided and secured in a positive-locking manner on the gear housing section 14 by way of the adjusting guide means 40 with the guide member 80, the handle 124 is, as a result, not rigidly aligned in relation to the gear housing section 14 but rather movable at least with play since the securing element 100 can merely serve to keep the locking projections 96 and 98 in engagement with the locking recesses 64 and 66 but not prevent any inclination of the guide member 80 in relation to the guide element 54.

For this reason, a clamping device is provided which has a support element 130 which engages over the guide member 80 and thus the two grooves 44 and 46 as well with an upper part 132 and extends with its side parts 134 and 136 from the upper part 132 in the direction of the housing section 14 so that the side parts 134 and 136 can be placed with their bottom surfaces 138 and 140 on the outer contour 72 of the segment 38 of the housing section on both sides of the grooves 44 and 46. The side parts 134 and 136 are preferably elements of an apron extending around the central section 82 of the guide member 80.

The upper part 132 of the support element 130 forms with its upper side facing away from the guide member 80 a support surface 142, against which the handle 124 can be supported with an end face 144 when the threaded pin 122 passes through an opening 133 in the upper part 132 and is turned into the threaded bore 120 of the guide member 80. In this case, the guide member 80 is drawn in the direction of the upper part 132 of the support element 130 so that this finally abuts on the guide bars 60 and 62 with its holding sections 88. As a result, the guide member 80 forms an abutment so that the handle 124 is increasingly moved with its end face 144 against the support surface 142 of the upper part 132 and thus the entire support element 130 is moved in the direction of the outer contour 72 until the bottom surfaces 138 and 140 of the side parts 136 rest on the outer contour 72 on both sides of the grooves 44 and 46, wherein, in the end, a rigid fixing of the handle 124 free from play results in relation to the gear housing section 14 due to the fact that the end face 144 of the handle 124 rests on the support surface 142 of the support element free from play and this again rests with the bottom surfaces 138 and 140 free from play on the outer contour of the segment 38 of the gear section 14 next to the grooves 44 and 46 in a clamped manner, wherein, in the long run, the clamping of the end face 144 of the handle against the support element 130 and the clamping of the support element 130 against the outer contour of the segment 38 of the housing section 14 is achieved by way of the threaded pin 122 as clamping element which, for its part, thereby draws the guide member 80 against the guide element 54.

If, on the other hand, the threaded pin 122 is turned out of the threaded bore 120, the clamping between the end face 144 of the handle 124 and the support element 130 is released and also the clamping between the support element 130 and the outer contour of the segment 38 of the gear housing section 14 and play can be achieved between the end face 144 and the support element 130 due to further turning such that due to action on the handle 124 in the direction of the grooves 44, 46 the guide member can be pressed into the grooves 44, 46 against the force of the securing element 100 to such an extent until the locking projections 96, 98 become disengaged from the locking recesses 64, 66 in the guide element 54 and the guide member 80 is movable along the guide element 54 in the adjusting guide means 40 into one of the positions 42.

Figure 6:
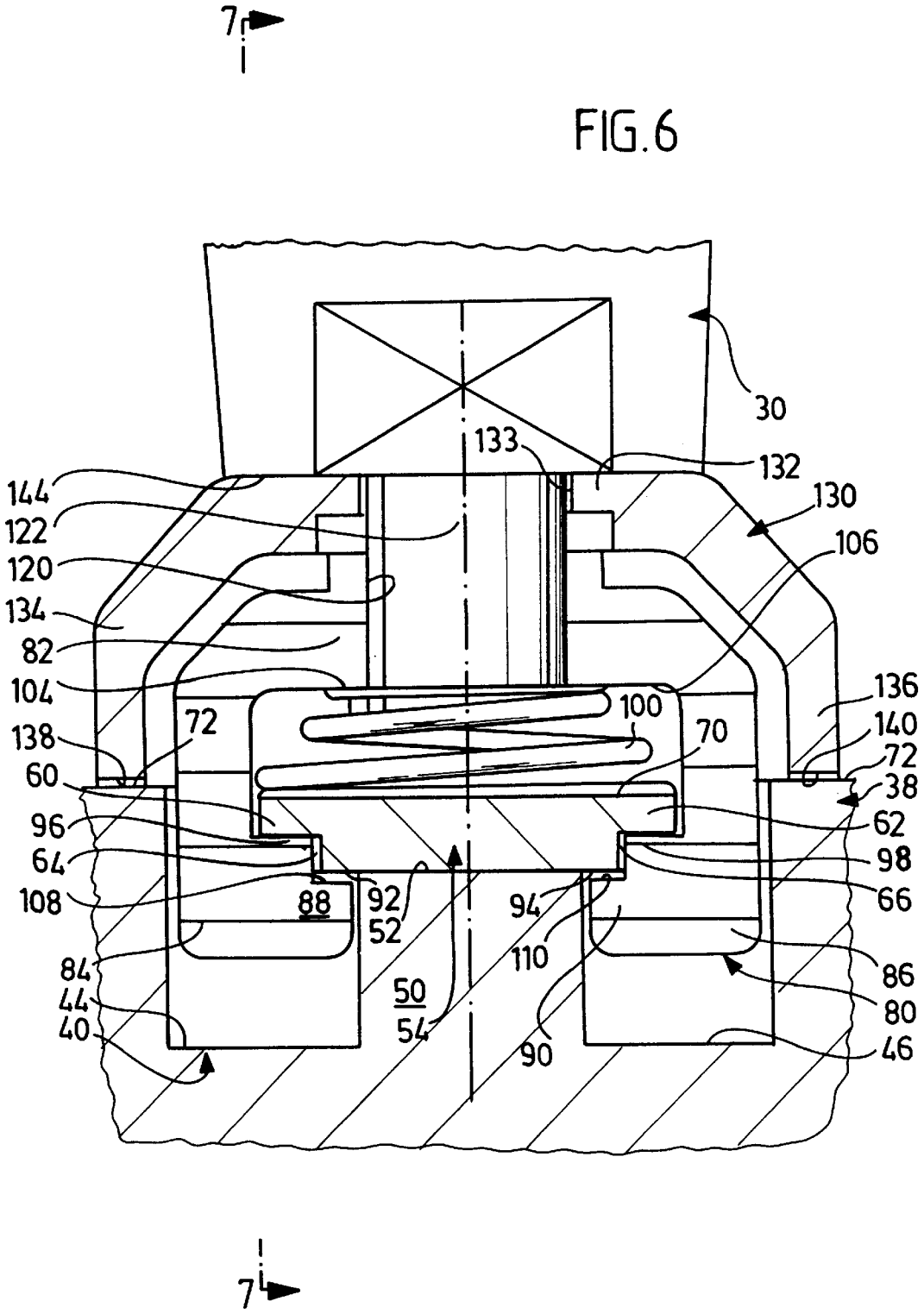
FIG. 6 shows a cross section similar to FIG. 3 through a second embodiment but along line 6—6 in FIG. 7.
Figure 7:
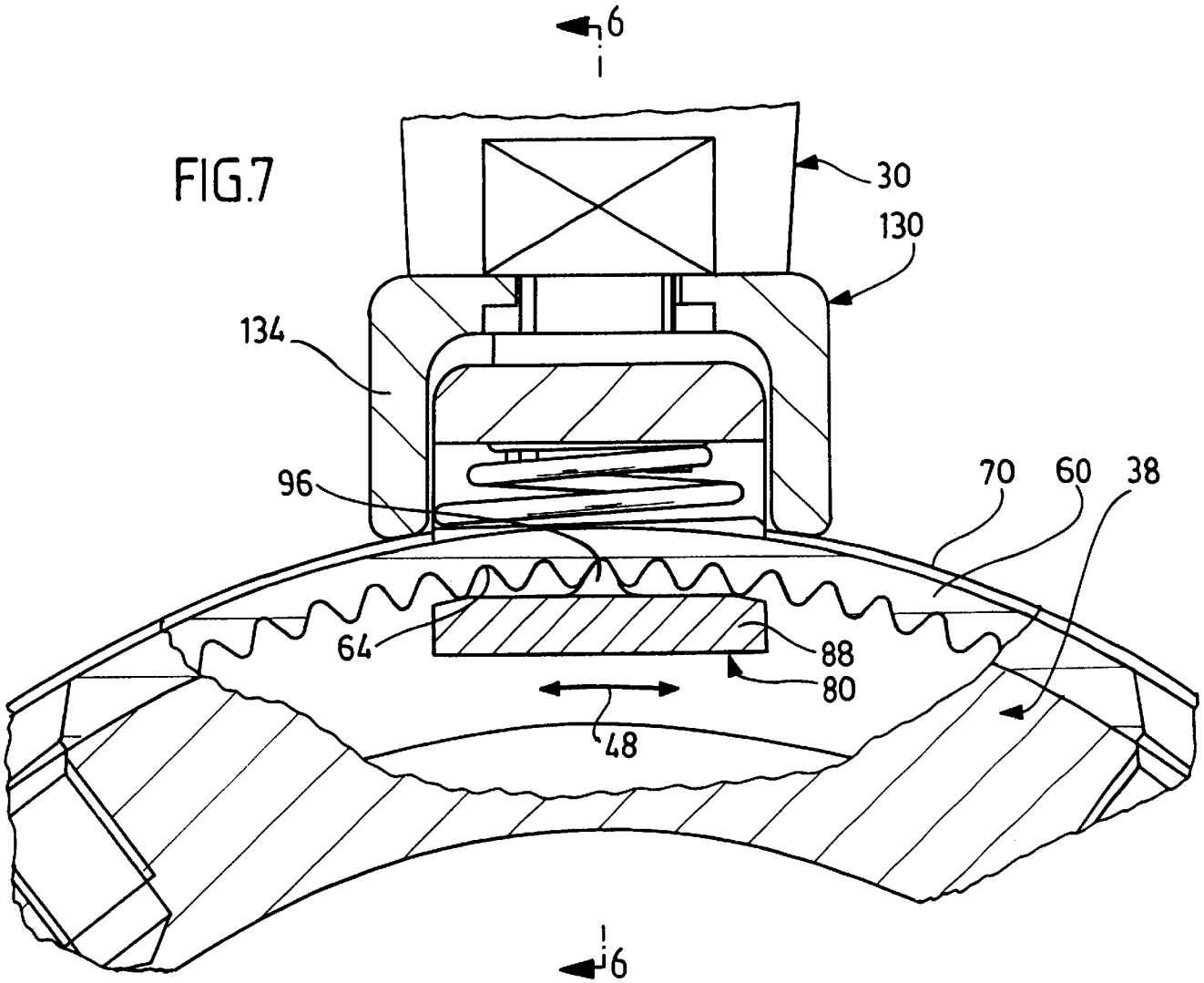
FIG. 7 shows a longitudinal section similar to FIG. 4 through the second embodiment along line 7—7 in FIG. 6.

In a second embodiment of an inventive hand machine tool, illustrated in FIGS. 6 and 7, those parts which are identical to those of the first embodiment are provided with the same reference numerals and so with respect to their description reference is made in full to the comments on the first embodiment.

In contrast to the first embodiment, the guide element 54 of the second embodiment is designed such that it does not have in the region of its guide bars 60, 62 locking recesses penetrating them in their entire thickness but, as illustrated in FIG. 7, in particular, a wavy-like or ripple-like structure on a side of the guide bars 60, 62 facing the grooves 44, 46, the indents of this structure forming the locking recesses 64, 66.

Furthermore, the holding sections 88 and 90 of the guide member are each provided with a locking projection 96, 98 which is in a position to dip into one of the indents forming the locking recesses 64, 66 and thus to serve for a positive-locking fixing of the guide member 80 on the guide element 54.

The second embodiment represents altogether a variation of the first embodiment.

Figure 10:
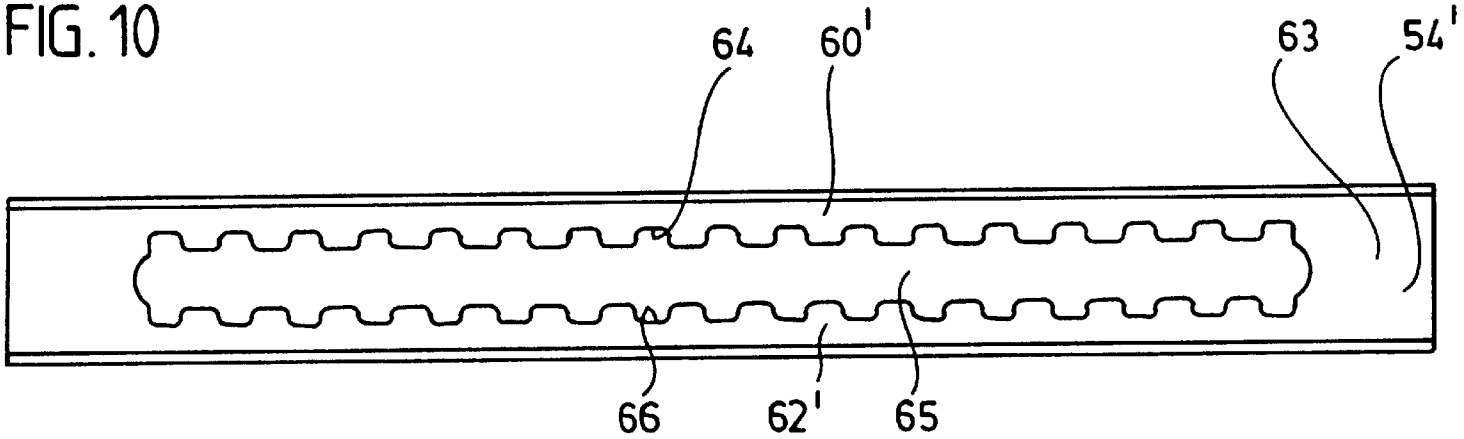
FIG. 10 shows a rolled out illustration of the guide element of the second embodiment similar to FIG. 5.
Figure 8:
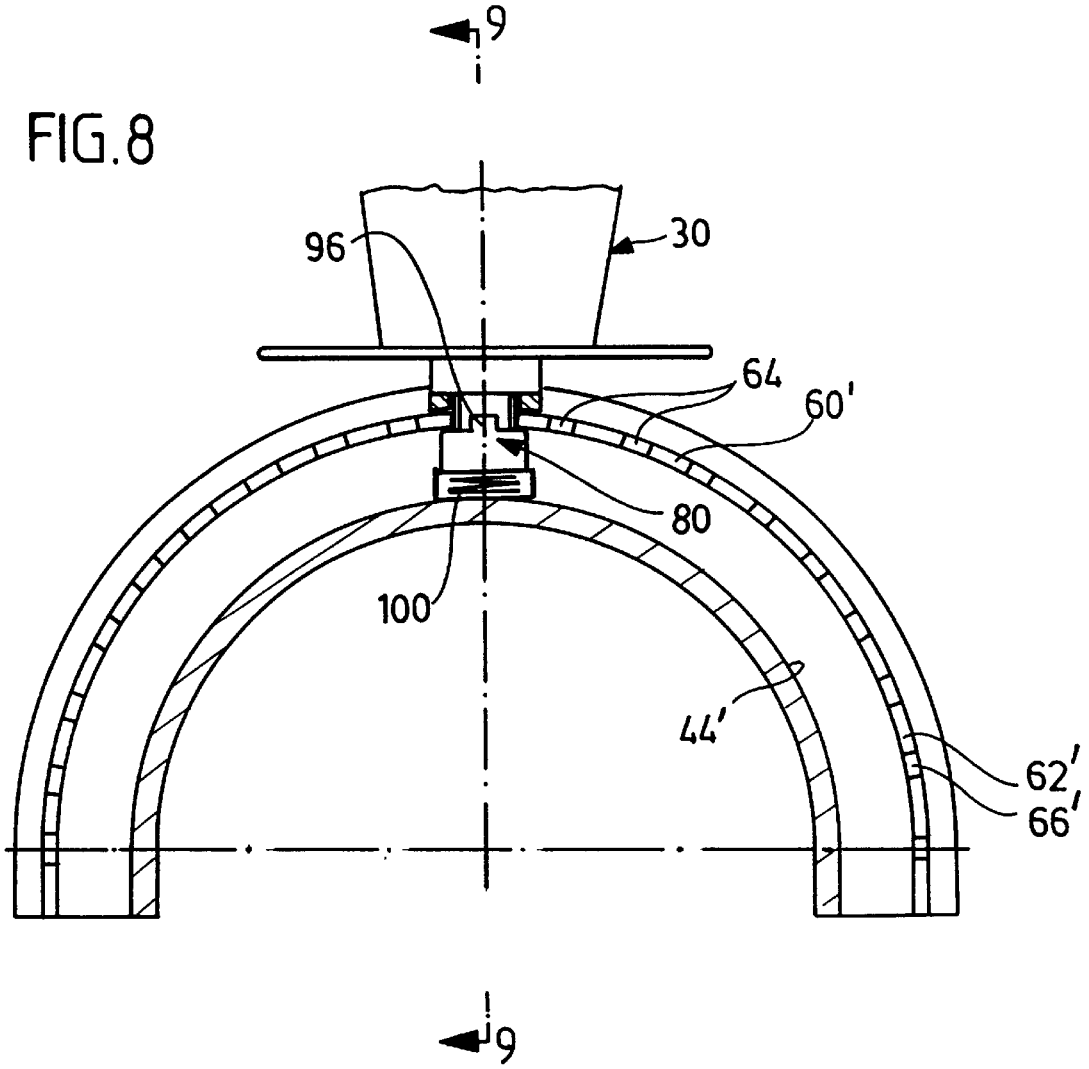
FIG. 8 shows a longitudinal section similar to FIG. 4 through a second embodiment but along line 8—8 in FIG. 9.
Figure 9:
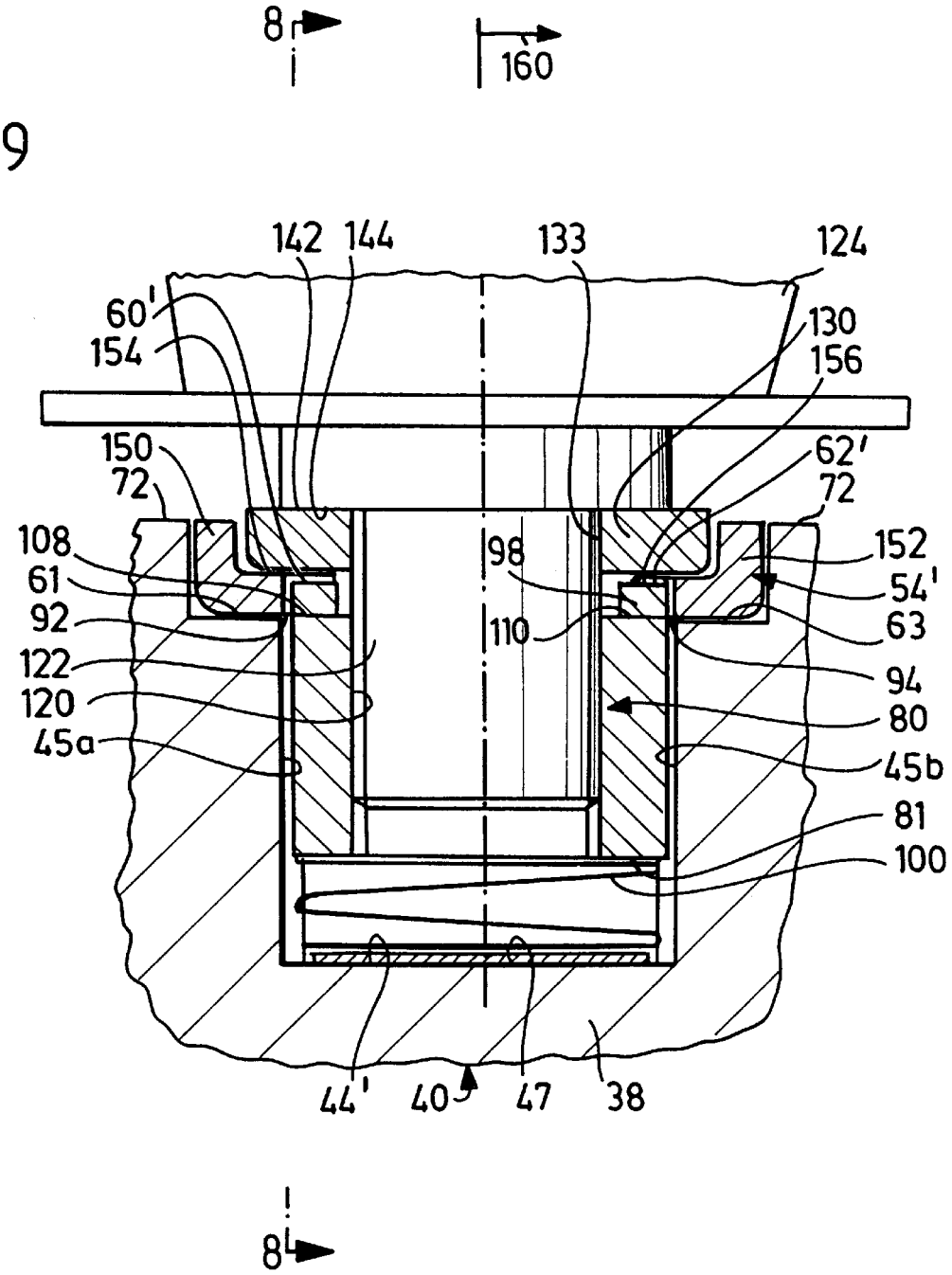
FIG. 9 shows a cross section similar to FIG. 3 through the second embodiment along line 9—9 in FIG. 8

In a third embodiment of an inventive hand machine tool, illustrated in FIGS. 8 to 10, the adjusting guide means 40 merely comprises one groove 44', guide bars 60' and 62', which, as illustrated in FIG. 8, are connected at their ends to the guide element 54' via end sections 63, projecting beyond the lateral, oppositely located walls 45*a* and 45*b* of this groove.

An intermediate space 65, which is penetrated by the threaded pin 122 of the handle 124, thus remains between the guide bars 60' and 62'. In the third embodiment, the guide member 80 is located as a whole in the groove 44' and has on its side facing the guide bars 60' and 62', on the one hand, the support surfaces 108 and 110 and, on the other hand, the locking projections 96 and 98 which project upwardly beyond the support surfaces 108 and 110 and can be brought into engagement with the locking recesses 64 and 66.

The securing element 100 designed as a pressure spring is supported in the third embodiment, in addition, on a groove base 47 of the groove 44' and acts on an underside 81 of the guide member 80 in such a manner that the guide member 80 is always pressed in the direction of the guide bars 60' and 62'.

In the third embodiment, the guide bars 60' and 62' are preferably arranged in relation to the outer contour 72 of the segment 38 so as to be likewise recessed in edge grooves 61 and 63 bordering laterally on the groove 44' and a side wall 150 and 152, which is upright in relation to the guide bars 60' and 62' and reaches as far as the outer contour 72 of the segment 38, is preferably formed thereon.

The support element 130 is provided on the guide bars 60' and 62', namely lying on an upper side 154 and 156, respectively, thereof, this support element being part of the clamping device but in the third embodiment not being supported directly on the outer contour 72 but likewise on the guide bars 60' and 62'.

The support element 130 is thereby designed, in the simplest case, as a plate with a central bore 133 which is penetrated by the threaded pin 122 which, exactly as in the first embodiment, is screwed into a threaded bore 120 which, in the third embodiment, is, however, arranged in the guide member 80 located in the groove 44'.

For the clamping of the handle 124 free from play this is likewise supported with its end face 144 on the support surface 142 of the support element 130, wherein this can, in turn, be clamped against the upper side 154 and 156 of the guide bars 60' and 62' whereas, on the other hand, the threaded pin 122 serving as clamping element abuts the guide member 80 with the support surfaces 108 and 110 against the undersides 92, 94 of the guide bars 60' and 62'.

The third embodiment functions in the same way as the first embodiment and so reference can be made in full to the comments on the first embodiment.

In a variation not only of the first but also of the second or third embodiment it is possible to design one of the guide bars 60 or 62 without locking recesses 64 or 66 so that a positive-locking fixing is possible only with the respectively other guide bar 62, 60 and the guide member 80. This facilitates the release of the positive-locking fixing to the extent that after releasing the threaded pin 122 in the threaded bore 120 of the guide member 80 a tilting of the guide member 80 and thus merely a tilting of the handle 124 in a tilting direction 160 is required in order to bring the locking projections 98 out of engagement with the locking recesses 66 of the guide bar 62 while the guide member 80 is supported with the support surfaces 108 on the guide bar 60 not provided with any locking recesses 64. Such a release of the positive-locking connection between the locking projections 98 and the corresponding locking recess 66 is simplified in comparison with the embodiments described thus far to the extent that it is not the entire handle 124 which has to be displaced in the direction of the groove 44 in order to press the guide member 80 likewise as a whole into the groove 44; however, the securing in the respective position 42 is less reliable for as long as the handle is not clamped free from play.

In a further variation, in particular, a variation of the first embodiment it would also be possible to omit the support element 130 for the clamping of the handle and bring about the clamping of the handle 124 in relation to the segment 38 by the threaded pin 122 being supported with its end face 162 on the upper side 70 of the guide element 54.

The present disclosure relates to the subject matter disclosed in German Application No. 198 54 468.5 of Nov. 25, 1998, the entire specification of which is incorporated herein by reference.

What is claimed is:

1. A hand machine tool comprising an elongated housing, a drive motor arranged in the housing for driving a tool holder with a rotational axis (18) via a miter gear, a first handle unit arranged on a housing section located close to the tool holder and aligned transversely to a longitudinal axis of the housing and a second handle unit arranged on the housing, characterized in that the first handle unit (30) is held for guidance with an adjusting guide system (40) on the housing (10), the adjusting guide system (40) being adjustable within an angular range of at least 90° about a longitudinal axis (20) of the housing (10) between several possible positions (42) and is fixable in a positive-locking manner in the respective position (42), wherein the longitudinal axis (20) runs substantially through rotational axis (18).

2. A hand machine tool as defined in claim 1, characterized in that the adjusting guide system (40) comprises a guide path structure (92, 94) for guiding a guide member (80) connected to the first handle unit (30) in a positive-locking manner between the various positions (42).

3. A hand machine tool as defined in claim 2, characterized in that the guide path structure (92, 94) extends along an outer contour (72) of the housing (10).

4. A hand machine tool as defined in claim 2, characterized in that the guide path structure (92, 94) extends in a recessed manner in relation to the outer contour (72) of the housing (10).

5. A hand machine tool as defined in claim 1, characterized in that the adjusting guide system (40) has at least one guide bar (60, 62) extending in the direction of guidance (48), a guide member (80) being connected to the handle unit (30), the guide member engaging behind said bar.

6. A hand machine tool as defined in claim 5, characterized in that the guide bar (60, 62) is provided with a row of positive-locking elements (64, 66) adapted to be brought into engagement with corresponding positive-locking elements (96, 98) on the guide member (80) connected to the first handle unit (30).

7. A hand machine tool as defined in claim 6, characterized in that a securing element (100) is provided for securing the positive-locking elements (64, 66, 96, 98) in their positive-locking positions.

8. A hand machine tool as defined in claim 7, characterized in that the securing element comprises a retaining spring (100).

9. A hand machine tool as defined in claim 7, characterized in that the securing element (100) is arranged so as to be supported on the adjusting guide system (40).

10. A hand machine tool as defined in claim 7, characterized in that the securing element (100) is actuatable via a handle (124) of the handle unit (30).

11. A hand machine tool as defined in claim 1, characterized in that the first handle unit (30) is positionable on the housing (10) free from play in the respective position fixed in a positive-locking manner by means of a clamping device (122, 130, 162).

12. A hand machine tool as defined in claim 11, characterized in that the clamping device has a clamping element (122) for abutting a support element (130, 162) of the handle unit (30) against the housing (10) in a clamped manner.

13. A hand machine tool as defined in claim 12, characterized in that the clamping element (122) engages on the guide member (80) guided in the adjusting guide system (40).

14. A hand machine tool as defined in claim 12, characterized in that the clamping element (122) is designed as a clamping gear element (122).

15. A hand machine tool as defined in claim 14, characterized in that the clamping element is designed as a clamping spindle (122).

16. A hand machine tool as defined in claim 1, characterized in that the first handle unit (30) is adapted to be fixed discontinuously in a positive-locking manner.

17. A hand machine tool as defined in claim 16, characterized in that the first handle unit (30) is adapted to be fixed discontinuously in a positive-locking manner in steps from smaller than to equal to 90°.

18. A hand machine tool as defined in claim 17, characterized in that the first handle unit is adapted to be fixed discontinuously in a positive-locking manner in steps from smaller than to equal to 30°.

19. A hand machine tool as defined in claim 1, characterized in that the handle unit (30) is aligned in one of the possible positions (42) approximately parallel to the rotational axis (18) of the tool holder (16).

20. A hand machine tool as defined in claim 1, characterized in that the handle unit (30) is aligned in one of the possible positions (42) approximately at right angles to the axis rotational (18) of the tool holder (16).

* * * * *